United States Patent [19]

Shon et al.

[11] Patent Number: 5,013,965

[45] Date of Patent: May 7, 1991

[54] ELECTRON GUN CATHODE AND MANUFACTURING METHOD THEREFOR

[75] Inventors: Suk-bong Shon, Suwon; Woo-young Na, Changweon, both of Rep. of Korea

[73] Assignee: Samsung Electron Devices Co., Ltd., Rep. of Korea

[21] Appl. No.: 430,645

[22] Filed: Oct. 31, 1989

[30] Foreign Application Priority Data

Nov. 2, 1988 [KR] Rep. of Korea ..... 88-14402

[51] Int. Cl.[5] ..... H01J 29/04; H01J 29/48; H01J 9/04

[52] U.S. Cl. ..... 313/446; 313/270; 445/35; 445/46

[58] Field of Search ..... 313/446, 270, 346 R, 313/346 DC, 456; 445/35, 46, 50, 51

[56] References Cited

U.S. PATENT DOCUMENTS

| | | | |
|---|---|---|---|
| 2,386,790 | 10/1945 | Gaun et al. | 313/446 X |
| 3,898,721 | 8/1975 | Decker et al. | 313/270 X |
| 4,403,169 | 9/1983 | Blanken | 313/446 |

*Primary Examiner*—Sandra L. O'Shea
*Attorney, Agent, or Firm*—Leydig, Voit & Mayer

[57] ABSTRACT

An electron gun cathode and a manufacturing method therefor includes a unitary cylindrical sleeve having a bottom with through-holes for the passage of the terminals of a heater. The heater is disposed in a closed space formed by the sleeve and a base joined to the sleeve opposite its bottom. The heater is sealed in the closed space of the sleeve and base to promote thermal efficiency, reduce heat loss between the base and the sleeve, and reduce power consumption of the cathode.

5 Claims, 1 Drawing Sheet

ELECTRON GUN CATHODE AND MANUFACTURING METHOD THEREFOR

FIELD OF THE INVENTION

The present invention relates to an electron gun cathode and a manufacturing method therefor and, particularly, to an improved heater type cathode and a manufacturing method therefor in which an increase of thermal efficiency and a lowering of power consumption are realized.

BACKGROUND OF THE INVENTION

The usual heater type cathode, as shown in FIG. 1, includes a cathode material 1 as a source of electrons, a metal base 2 for spreading the cathode material thereon, a sleeve 3 for supporting the base 2 and for enclosing a heater 5, and a holder 4 for supporting the sleeve 3. The above mentioned components are separately manufactured, assembled by spot welding, and the cathode material 1 is spread on the surface of the base 2 by spraying.

In such a cathode, the heat energy is transmitted from the heater 5 to the metal 2 and to the cathode material 1 forming the surface layer of the base 2 to cause thermal electron emission. To obtain a desired thermal electron emission, the transmission efficiency of heat from the heater 5 to the base 2 has to be maximized.

However, a heater type cathode employs an indirect heating method and, consequently, increases in thermal efficiency are limited. In such a heater type cathode, there are many causes for heat loss such as the thermal resistance between the sleeve and the base, heat radiation resistance, and leakage of the radiated heat between the sleeve and the heater. Particularly, the thermal resistance and the radiated heat leakage are large factors reducing thermal efficiency.

The thermal resistance is further increased because the base metal and the sleeve are spot-welded at a plurality of spots, thereby leaving small gaps other than at the welded spots. Meanwhile, the radiated heat leakage occurs through the lower opening of the sleeve. An experiment demonstrated that the radiated heat leakage accounts for the greater part of the total heat loss.

Such heat losses, increase the time required for heating up the cathode material to the operating temperature through the heat energy of the heater. If this time increase is to be prevented, the amount of the current supplied to the heater has to be raised, increasing power consumption, but there are many restrictions against increasing consumption of electric power.

SUMMARY OF THE INVENTION

Therefore, it is the object of the present invention to provide an electron gun cathode and a manufacturing method therefor having an increased thermal efficiency and reduced electric power consumption.

To accomplish the above object, the cathode of the present invention comprises a metal cathode material, a base on which the cathode material is disposed, a heater, a sleeve fixedly supporting the base metal, and enclosing the heater, the sleeve being cylindrical and having a bottom, the bottom having two through-holes through which the terminals of the heater pass, and the heater is disposed in a closed space formed by the sleeve and the base.

To accomplish the above object, the manufacturing method for the electron gun comprises inserting the heater into a sleeve having a bottom including through-holes for passage of the terminals of the heater outside of the sleeve, installing a metal base at the top of the sleeve, heating the base and the sleeve to alloy them, and applying spreading the cathode material on the base.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
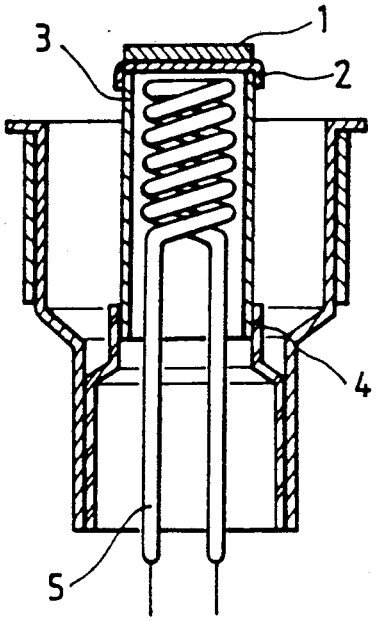
FIG. 1 is a sectional view of a conventional electron gun cathode.
Figure 3:
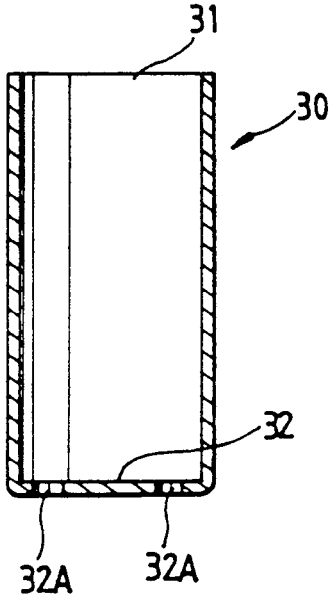
FIG. 3 is a sectional view of the sleeve adopted of the cathode of FIG. 2.
Figure 2:
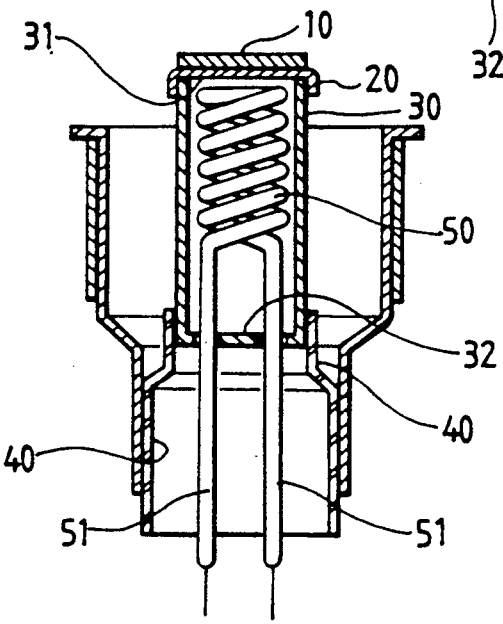
FIG. 2 is a sectional view of a preferred embodiment of an electron gun cathode according to the present invention.

FIG. 2 illustrates a cathode according to the present invention, in which a cathode material 10 is disposed on a metal base 20, and the base 20 is secured to an opening 31 of a sleeve 30 which encloses a heater 50. As shown in FIG. 3, the sleeve 30 has a bottom 32 opposite opening 31 including two through-holes 32A, 32A. As shown in FIG. 2, terminals 51 of the heater 50 are exposed outside of the sleeve 30 after passing through the through-holes 32A, 32A. The sleeve 30 is supported by a holder 40 disposed below the lower portion thereof.

The manufacturing method for the electron gun cathode is carried out in the following manner.

(1) First the cathode components such as the metal base 20, the sleeve 30, the heater 50 and the holder 40 are manufactured through the usual processes. Here, the sleeve 30 is provided with a bottom 32, and the bottom 32 is provided with two through-holes 32A, 32A.

(2) The heater 50 is inserted into the sleeve 30 with terminals 51, 51, of the heater 50 passing through the through-holes 32A, 32A of the sleeve 30.

(3) The base 20 is installed on the upper opening portion 31 of the sleeve 30. This assembly is heated to a temperature of over 800° C., so that spread welds are made through alloying between the sleeve 30 and the base 20. The heating is carried out within a heating furnace filled with $H_2$ gas.

(4) The impurities adhered on the base are removed, and the cathode material 10 is applied by spraying.

The electron gun cathode manufactured according to the method of the present invention is constructed such that the heater 50 is disposed in the sealed space formed between the base 20 and the sleeve 30. Therefore, the heat energy radiated from the heater 50 does not leak to the outside, but is mostly transferred to the sleeve 30. The heat absorbed by the sleeve 30 is conducted to the base with high thermal efficiency, because the thermal resistance between the sleeve 30 and the base metal 20 is minimized owing to the spread welding.

As described above, the electron gun cathode according to the present invention promotes thermal efficiency and inhibits the heat loss between the base and the sleeve, thereby providing the advantage that electric power consumption is very low. Further, as described above, the heat energy from the heater is not only efficiently transferred to the base, but also the transmission speed of the heat energy is maximized, with the result that the time required for initiating the release of the thermal electrons from the cathode material is greatly shortened, thereby greatly reducing the start-up time.

What is claimed is:

1. An electron gun cathode comprising:

a cathode material for emitting electrons;

a base on which said cathode material is disposed;

a heater; and a unitary cylindrical sleeve on which said base is mounted and enclosing the heater, said sleeve including a bottom having through-holes for the passage of terminals of said heater, said heater being disposed in a closed space formed by said sleeve and said base.

2. The electron gun cathode of claim 1 wherein said base is continuously joined to said sleeve.

3. The electron gun cathode of claim 1 wherein said base is alloyed to said sleeve.

4. A manufacturing method for an electron gun cathode comprising:

inserting a heater into a unitary sleeve including a bottom having through-holes with the terminals of the heater passing through said through-holes, and placing a base on an opening of said sleeve opposite said bottom;

heating the base and the sleeve to alloy them together; and depositing a cathode material on said base.

5. The manufacturing method as claimed in claim 4 including heating said sleeve and base to a temperature of over 800° C. in an atmosphere of $H_2$ gas.

* * * * *